United States Patent [19]

Steinhilber

[11] 4,416,559

[45] Nov. 22, 1983

[54] APPARATUS, MOUNTABLE ON AN OFFICE MACHINE, FOR FEEDING SINGLE SHEETS FROM A PAPER STACK STORED IN A MAGAZINE

[76] Inventor: Helmut Steinhilber, Koenigstrasse 47, Rottweil, Fed. Rep. of Germany

[21] Appl. No.: 269,007

[22] PCT Filed: Oct. 15, 1980

[86] PCT No.: PCT/DE80/00151

§ 371 Date: Jun. 16, 1981

§ 102(e) Date: May 27, 1981

[30] Foreign Application Priority Data

Oct. 16, 1979 [DE] Fed. Rep. of Germany ..... 2941816

[51] Int. Cl.[3] ..... B41J 13/10

[52] U.S. Cl. ..... 400/629; 400/636.2

[58] Field of Search ..... 400/624, 625, 629, 636.2; 271/127

[56] References Cited

U.S. PATENT DOCUMENTS

| | | | |
|---|---|---|---|
| 476,727 | 6/1892 | Brower et al. | 400/629 X |
| 881,126 | 3/1908 | Hutches, Jr. | 400/629 X |
| 994,905 | 6/1911 | Burch | 400/629 |
| 2,242,268 | 5/1941 | Sherman | 400/629 |
| 2,366,206 | 1/1945 | Metzner | 400/625 |
| 2,887,208 | 5/1959 | Cross | 400/629 |

FOREIGN PATENT DOCUMENTS

| | | | |
|---|---|---|---|
| 2632463 | 1/1978 | Fed. Rep. of Germany . | |
| 2816448 | 10/1979 | Fed. Rep. of Germany | 400/629 |
| 2857074 | 8/1980 | Fed. Rep. of Germany . | |
| 2910849 | 9/1980 | Fed. Rep. of Germany | 400/629 |
| 2950707 | 9/1980 | Fed. Rep. of Germany | 400/629 |
| 2941816 | 5/1981 | Fed. Rep. of Germany | 400/624 |
| 2399697 | 3/1979 | France . | |
| 2341440 | 9/1979 | France . | |
| 2422504 | 11/1979 | France . | |
| 55-135033 | 10/1980 | Japan | 271/127 |

OTHER PUBLICATIONS

IBM Technical Disclosure Bulletin, "Pre-Buckle Forming Back-Up Plate for Supply Cassette", Gunnell, vol. 23, No. 3, Aug. 1980, pp. 947–948.

*Primary Examiner*—Ernest T. Wright, Jr.
*Attorney, Agent, or Firm*—Blair, Brown & Kreten

[57] ABSTRACT

The invention relates to an apparatus for feeding single sheets from a stack of paper stored in a magazine to the platen of an office machine. The apparatus is capable of being mounted on the office machine, the drive of a separate-feed roller frictionally engaging the stack of paper being effected by means of the platen in such a manner that when the platen is rotated counter to the direction in which the paper is inserted, the separate-feed roller is driven in the direction of paper insertion. In order to prevent the separate-feed roller from hindering paper insertion by the platen, the magazine pivotally engages a control cam. The control cam is driven by the platen in such a manner that it pivots the magazine against the separate-feed roller when the platen is rotated counter to the direction of paper insertion; when the platen is rotated in the direction of paper insertion, the control cam pivots the magazine away from contact with the separate-feed roller.

5 Claims, 6 Drawing Figures

FIG 4A
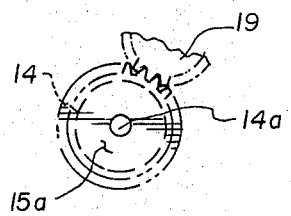
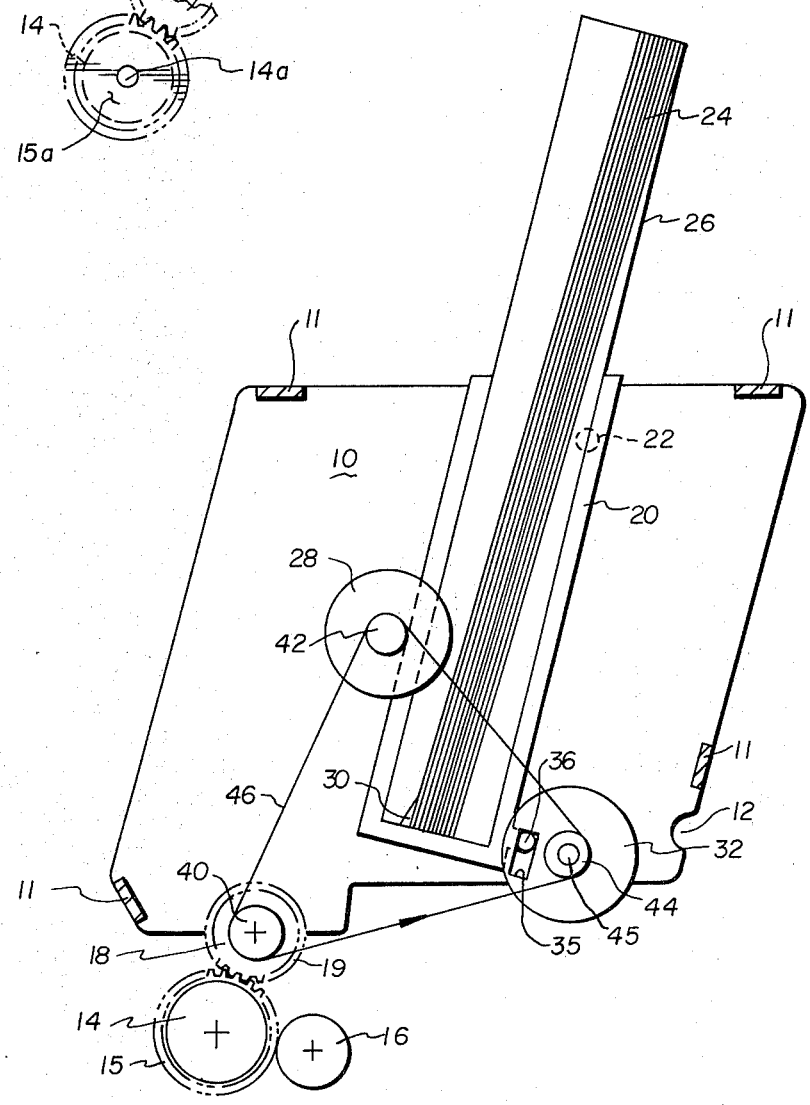
FIG 4

APPARATUS, MOUNTABLE ON AN OFFICE MACHINE, FOR FEEDING SINGLE SHEETS FROM A PAPER STACK STORED IN A MAGAZINE

BACKGROUND OF THE INVENTION

The invention relates to an apparatus for feeding single sheets from a stack of paper stored in a magazine. The apparatus is capable of being mounted on an office machine.

OBJECT AND SUMMARY OF THE INVENTION

This apparatus is mounted on an office machine, and a drive wheel of the apparatus comes into engagement with the platen of the office machine, preferably by reason of its own weight. The drive of the separate-feed roller, which draws the single sheets from the magazine of the apparatus, is effected via a gear mechanism by means of the drive wheel, and thus by means of the platen. The apparatus accordingly requires no drive motor or control means of its own. The drive and control of the apparatus are accomplished by means of the office machine itself.

The drive wheel and separate-feed roller are interconnected by a gear mechanism designed, in this apparatus, such that the separate-feed roller is driven in the direction in which paper is inserted, if the platen rotates in the direction counter thereto. In order to deliver a single sheet from the magazine to the platen, the platen is rotated in a controlled manner counter to the direction in which the paper is inserted. In so doing, the separate-feed roller pushes the topmost sheet of the stack of paper stored in the magazine toward the entrance slit of the platen, but the paper is not inserted into the slit because the platen is being rotated counter to the direction of paper insertion. The sheet of paper is accordingly forced into a convex shape in front of the entrance slit of the platen, its forward edge assuming a precisely defined position. In order to insert the paper, the platen is then rotated in the paper insertion direction, and the pre-positioned, bulging sheet of paper is thus inserted in a controlled manner based on this precisely defined outset position.

This apparatus enables the pre-positioned sheet to be inserted from a precisely defined outset position, so that the sheet can be precisely positioned in terms of vertical spacing by means of the platen. The apparatus is extremely simple in structure, because it utilizes the drive and control means of the office machine itself, which are already available, and does not require its own drive means or control means.

In order to prevent the separate-feed roller, which engages the topmost sheet of the stack of paper, from hindering the insertion of this sheet by the platen, the magazine is pivotally supported and in engagement with a control cam. The control cam is movable by the drive wheel, via a gear mechanism, in such a way that when the platen is rotated counter to the paper insertion direction, the control cam pivots the magazine into a position in which the stack of paper contacts the separate-feed roller; when the platen is rotated in the paper insertion direction, the control cam pivots the magazine into a position in which the stack of paper is not in contact with the separate-feed roller.

Advantageous forms of embodiment and modifications of the invention are disclosed in the dependent claims.

In the magazine according to the invention, the magazine carrying the stack of paper is pivotally disposed, and it can be pivoted between two positions by means of a control cam. In one of these positions, the stack of paper in the magazine is held in contact with the separate-feed roller, so that this roller can, by frictional engagement, draw off the topmost sheet on the stack; in the other of these two positions, the paper stack in the magazine is pivoted away from the separate-feed roller, so that this roller does not engage the topmost sheet of the stack.

The movement of the control cam and thus the pivoting of the magazine are likewise effected by the platen, and thus by the office machine. This pivoting into and out of position of the magazine is therefore likewise accomplished without a separate drive or control means being required, in a manner which is precisely synchronized with the insertion of the paper. The simplest structure is attained for the apparatus if both the drive of the separate-feed roller and the drive of the control cam are accomplished via a single, common toothed belt by means of the drive wheel engaging the platen.

If the platen is rotated counter to the paper insertion direction, then the magazine, together with the stack of paper, is pivoted against the separate-feed roller, and this latter roller is driven in the paper insertion direction, so that the topmost sheet is drawn off the stack of paper and is pushed forward to the entrance slit of the platen to such an extent that it bulges upward. Then the platen is driven in the paper insertion direction. At the same time, the magazine and the stack of paper are pivoted away from the separate-feed roller, and the separate-feed roller is driven counter to the paper insertion direction. Since the separate-feed roller is no longer in contact with the topmost sheet of the stack of paper, the rotation of the separate-feed roller counter to the direction of paper insertion does not hinder the insertion of the paper through the platen.

The invention will be described in further detail below, in terms of an exemplary embodiment shown in the drawing.

BRIEF DESCRIPTION OF THE DRAWING

FIGS. 1, 2, 3, and 4 show the apparatus schematically in a vertical section representing four different operational states.

FIG. 4*a* is a partial view of FIG. 4 showing an alternate arrangement.

DESCRIPTION OF THE PREFERRED EMBODIMENTS

Figure 1:
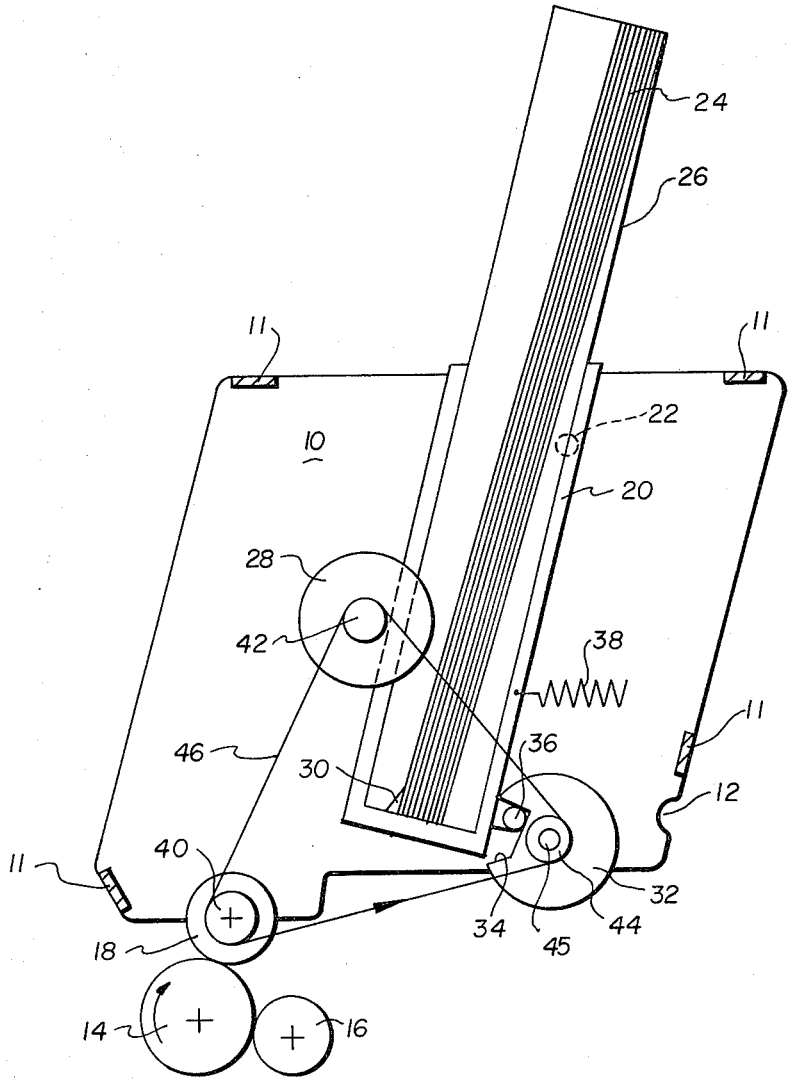

The apparatus has two side walls 10 which are rigidly interconnected by means of crosspieces 11. By means of an indentation 12 in the side walls 10, the apparatus can be mounted on top of an office machine in a pivotable fashion. Of this office machine, only the platen 14 and its counterpressure roller 16, disposed at and defining the paper entrance slit, are shown.

With a drive wheel 18, the apparatus is in engagement under its own weight with the platen 14. The drive wheel 18 may be a friction wheel mounted directly upon the platen 14 (FIG. 1 e.g.). The drive wheel may equally well be a gear wheel 19, which engages an annular gear 15 placed over the platen 14 or a geared wheel 15*a* attached to the shaft 14*a* of the platen 14 (FIGS. 4 and 4*a*).

One or more separate-feed rollers 28 are supported in the side walls 10 ahead of the magazine 20. The magazine 20 is pivotable about the shaft 22 in such a manner that in one pivoted position the stack of paper 24 rests with its topmost sheet against the separate-feed roller 28, so that the separate-feed roller 28, when it is rotated clockwise, frictionally engages this topmost sheet and, in cooperation with separate-feed corners 30 of the cassette 26, draws it from the stack of paper 24. In the other pivoted position of the magazine 20, the stack of paper 24 does not have contact with the separate-feed roller 28.

Behind the magazine 20, spaced radially apart from the pivot shaft 22 of the magazine 20, a circular plate 32 is supported rotatably in the side walls 10. The circular plate 32 has an indented portion of its circumference, which represents a radially increasing control cam 34. The radially indented ends of this control cam 34 represent stops which restrict the control cam 34 in the circumferential direction. The control cam 34 increases in size radially from its end which is most deeply indented and counterclockwise to its other end, which is the least deeply indented.

The magazine 20 contacts the control cam 34 by way of a pickup stylus 36, with a tension spring 38 keeping the pickup stylus 36 in contact with the control cam 34. The tension spring 38 may be inserted, for example, between the magazine 20 and one of the side walls 10.

If the circular plate 32 is rotated about an angle corresponding to the circumferential length of the control cam 34, the pickup stylus 36 tracks the control cam 34; the magazine 20 is pivoted thereby, in accordance with the radial length of the control cam 34, between the position in which the stack of paper 24 rests against the separate-feed roller 28 and the position in which the stack of paper 24 has been pivoted away from contact with the separate-feed roller 28.

In place of the control cam 34 embodied as an indented portion of the circumference (FIGS. 1–3), it is naturally possible to provide an oblong slot 35, of appropriate circumferential length and increase in radial size, within the circular plate 32, which is then engaged by the pickup stylus (FIG. 4). In this case, the spring 38 is superfluous.

A crown gear 40 is connected in a rotationally fixed manner with the drive wheel 18; a crown gear 42 is connected in a rotationally fixed manner with the separate-feed roller 28; and a crown gear 44 is connected via a slip coupling 45 with the circular plate 32. A single toothed belt 46, passing over the crown gears 40, 42 and 44, effects the drive of the separate-feed roller 28 and the circular plate 32 by means of the drive wheel 18 and thus by means of the platen 14.

The functioning of the apparatus will now be described with the aid of FIGS. 1–3.

In the position shown in FIG. 1, the pickup stylus 36 is located at the lowermost point of the control cam 34, and the magazine 20 is accordingly pivoted into the terminal position in which the stack of paper 24 is not resting against the separate-feed roller 28.

If it is now intended to deliver a sheet from the stack of paper 24 to the platen 14, then the platen 14 is driven counter to the paper insertion direction; that is, it is rotated counterclockwise as seen in the drawing, the rotation being effected by the office machine. This rotation of the platen 14 is taken over by the drive wheel 18 and transmitted via the toothed belt 46 to the separate-feed roller 28 and the circular plate 32. The separate-feed roller 28 and the circular plate 32 are thereby driven clockwise.

Figure 2:
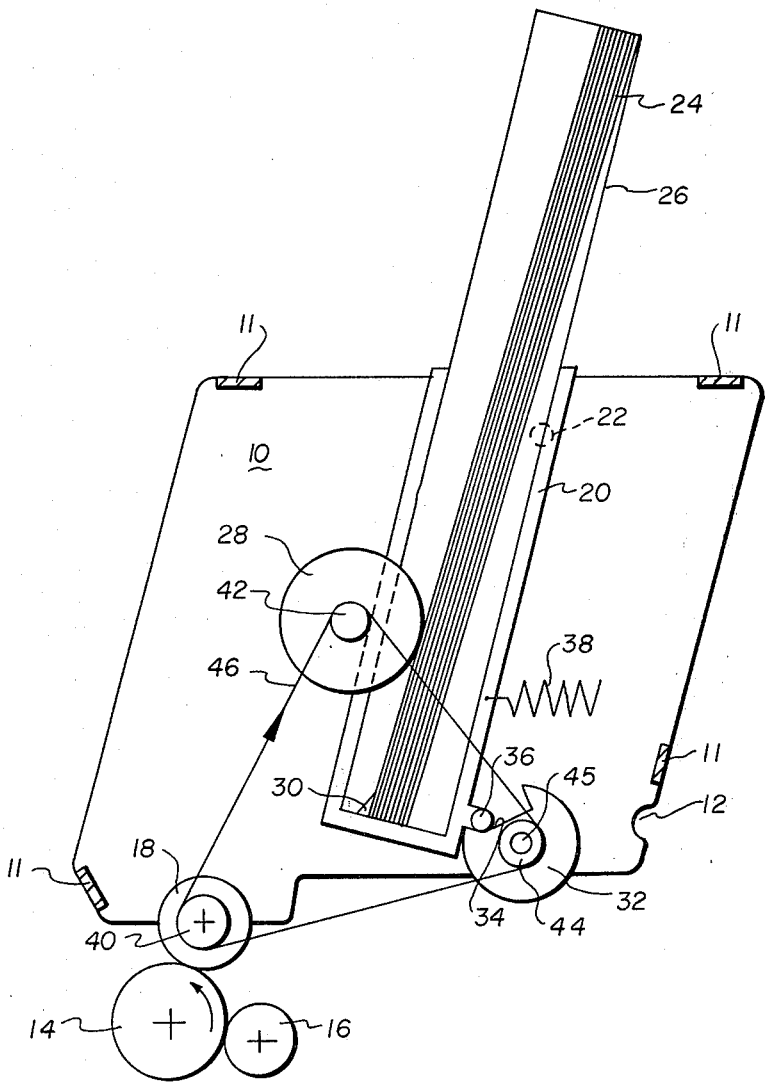
Figure 3:
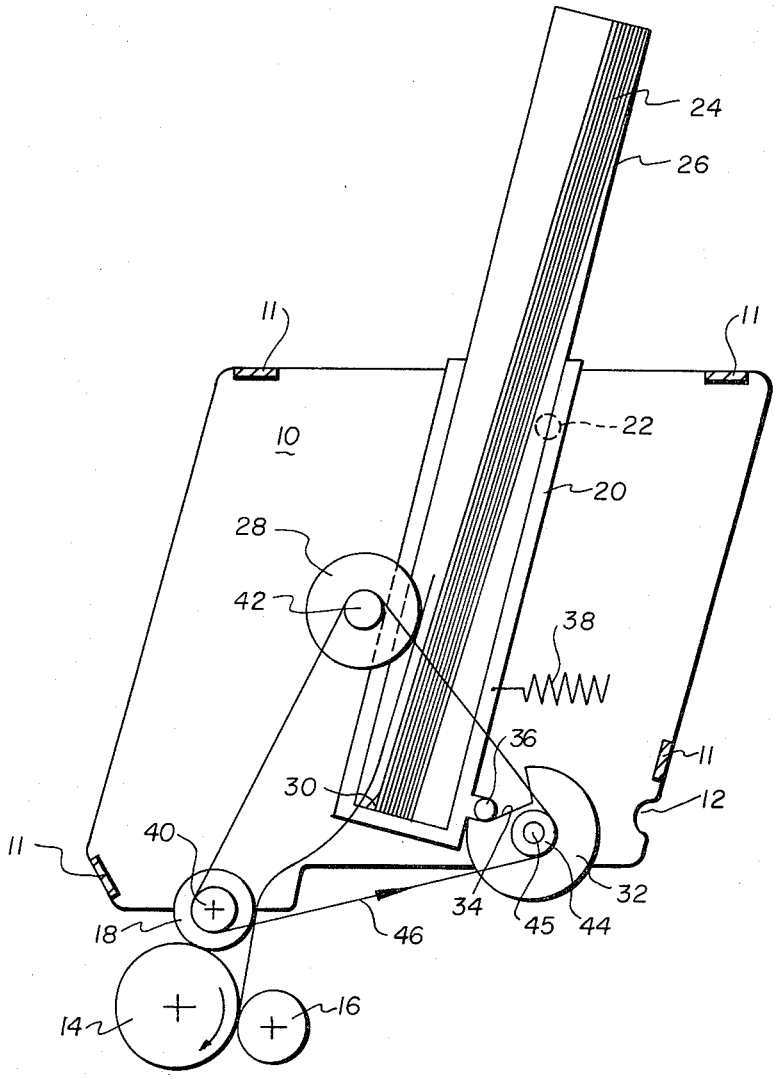
Figure 5:
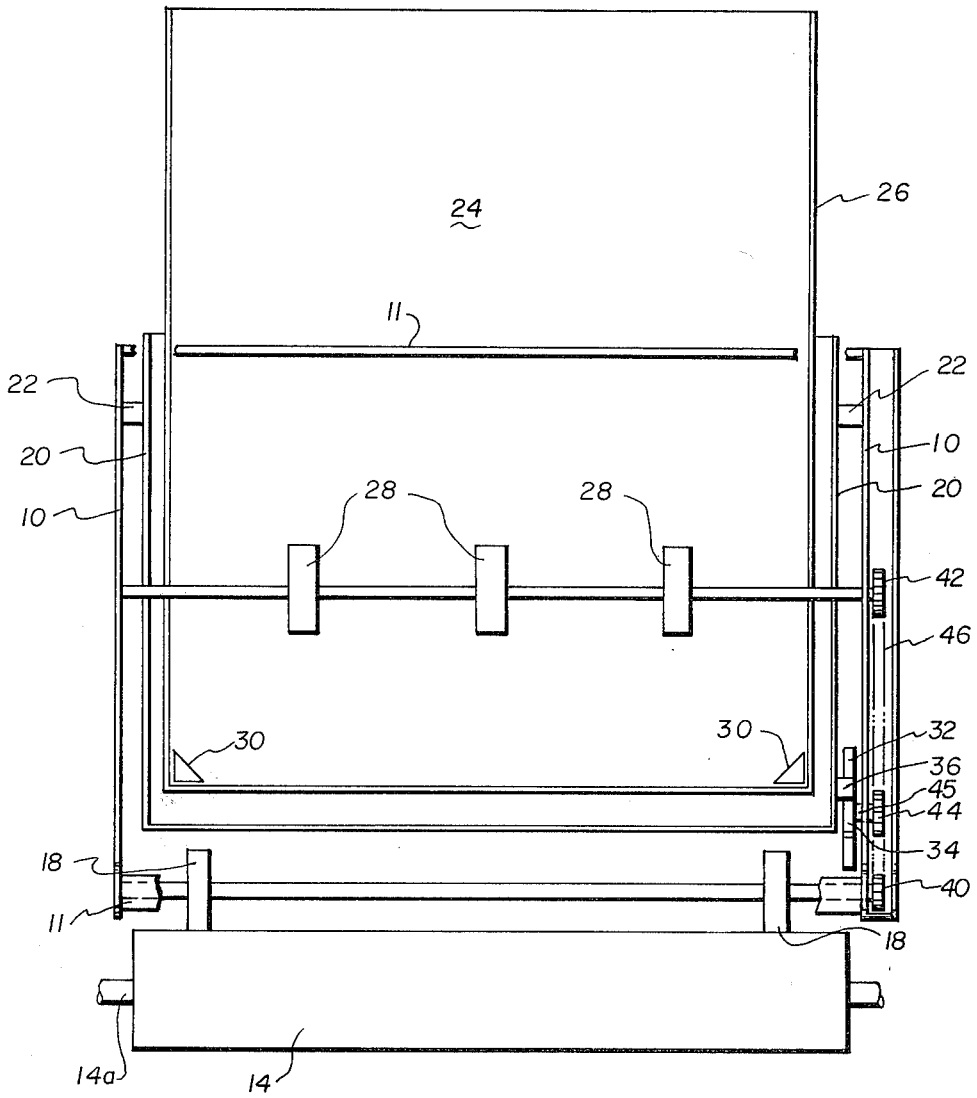
FIG. 5 is a front view of the apparatus.

During this rotation of the circular plate 32 in a clockwise direction, the pickup stylus 36 tracks the control cam 34 up to the position shown in FIG. 2, in which it is located at the highest point of the control cam 34. As a result, the magazine 20 is pivoted, so that the stack of paper 24 comes to rest with its topmost sheet in contact with the separate-feed roller 28.

Upon the further rotation of the platen 14 counter to the direction of paper insertion, in the position shown in FIG. 2, the circular plate 32 is located with a radial end stop of its control cam 34 against the pickup stylus 36, so that further rotation of the circular plate 32 is impossible. The slip coupling 45 between the circular plate 32 and the crown gear 44 becomes effective, and the crown gear 44 continues to rotate freely.

The separate-feed roller 28, rotating clockwise, frictionally engages the topmost sheet of the stack of paper 24, pushes it over the separate-feed corners 30, and directs it to the entrance slit formed between the platen 14 and the counterpressure roller 16. Since the platen 14 is being rotated counter to the direction of paper insertion, the sheet just delivered is not capable of entering the entrance slit; instead, as it is pushed further forward by the separate-feed roller 28, it bulges upward in front of the entrance slit, as is shown in FIG. 3.

After a sheet-advancement distance (controlled by the office machine) has been traversed, the sheet of paper at the entrance slit of the platen 14 curves upward to a sufficient extent. Now the platen 14, in the position shown in FIG. 3, is driven in the paper insertion direction; that is, clockwise as seen in the drawing. The pre-positioned, bulging sheet of paper, beginning at its precisely defined outset position, is introduced into the entrance slit which is formed by the platen 14 and the counterpressure roller 16.

At the same time, the rotation of the platen 14 by the drive wheel 18 is transmitted via the toothed belt 46 to the crown gears 42 and 44. The separate-feed roller 28 is therefore driven in the counterclockwise direction—that is, counter to the paper insertion direction. The circular plate 32 is likewise driven in the counterclockwise direction by the crown gear 44, by way of the slip coupling 45 which now is once again in a state of engagement; the result is that the pickup stylus 36 again moves to the lowest point on the control cam 34, and the magazine 20 is pivoted into the position in which the stack of paper 24 is no longer in contact with the separate-feed roller 28, as is shown in FIG. 1.

The convexity of the pre-positioned sheet of paper at the onset of insertion of the paper by the platen 14 is now sufficient to compensate for an initial, slight retraction of the topmost sheet of paper on the part of the separate-feed roller 28, this compensation being effected within the period of time required for pivoting away the magazine 20 by means of the control cam 34. A suitable translation ratio between the crown gears 40 and 44 assures that the magazine 20 or stack of paper 24 will be pivoted rapidly away from the separate-feed roller 28.

The insertion of the paper by the platen 14 is continued while the apparatus is in the position shown in FIG. 1. The separate-feed roller 28 rotates counter to the paper insertion direction without coming into engagement with the stack of paper 24, and the crown gear 44, because of the slip coupling 45, rotates freely while the circular plate 32 is held firmly in position by the pickup stylus 36. After a printing procedure has been accomplished, the operation described above begins anew, and the next sheet of paper is delivered from the stack of paper 24.

What is claimed is:

1. An apparatus, mountable on an office machine, for feeding single sheets from a stack of paper stored in a magazine (20) to a platen (14) of the office machine having a separate-feed roller (28) frictionally engaging the stack of paper, having a drive wheel (18) driven, when the apparatus is mounted, by the platen (14), and having a gear mechanism (40, 42, 46) connecting said drive wheel (18) with said separate-feed roller (28) in such a manner that upon the rotation of the platen (14) counter to the paper insertion direction said separate-feed roller (28) is driven in the paper insertion direction, wherein said magazine (20) is pivotally supported and is in engagement with a control cam (34), and said control cam (34) is movable by said drive wheel (18) via said gear mechanism (40, 42, 46) in such a manner that upon the rotation of the platen (14) counter to the paper insertion direction said control cam (34) pivots said magazine (20) into a position in which the stack of paper (24) rests against said separate-feed roller (28), and upon rotation of the platen (14) in the paper insertion direction said control cam (34) pivots said magazine (20) into a position in which the stack of paper (24) does not rest against said separate-feed roller (28).

2. An apparatus as defined in claim 1, characterized in that said control cam (34) extends in a circumferential direction on a plate rotatably coupled to a wheel (44) of said gear mechanism by a slip coupling (45), said plate having a circumference, said control cam (34) being restricted by stops and increasing radially in size.

3. An apparatus as defined by claim 2, characterized in that said control cam (34) is embodied as an indented portion of said circumference, a pickup stylus (36) of said magazine (20) resting thereon under the tension of a spring (38).

4. An apparatus as defined in claim 2, characterized in that said control cam is embodied as an oblong slit (35) which is engaged by a pickup stylus of said magazine (20).

5. An apparatus as defined by claim 1 characterized in that said separate-feed roller (28) and said control cam (34) are driven by said drive wheel (18) by means of a single, common toothed belt (46).

* * * * *